United States Patent [19]

Segati

[11] Patent Number: 5,060,827

[45] Date of Patent: Oct. 29, 1991

[54] LOW PROFILE ANTI-DRIP DOSING CAP AND SPOUT FOR LIQUID CONTAINERS

[75] Inventor: Umberto D. I. Segati, Brussels, Belgium

[73] Assignee: Colgate-Palmolive Company, Piscataway, N.J.

[21] Appl. No.: 521,287

[22] Filed: May 9, 1990

[51] Int. Cl.[5] ..... B67D 1/16

[52] U.S. Cl. ..... 222/109; 141/381; 222/111; 222/552; 222/562; 222/568; 222/571

[58] Field of Search ..... 222/108–111, 222/552, 554, 562, 563, 566, 570, 571; 141/381; 215/354, 356, 357, 351, 31, 100.5, DIG. 7

[56] References Cited

U.S. PATENT DOCUMENTS

| | | | |
|---|---|---|---|
| 1,603,898 | 10/1926 | Boyce | 222/552 X |
| 1,780,875 | 11/1930 | Gordon | 141/381 |
| 1,794,098 | 2/1931 | Aulbach et al. | 222/109 |
| 2,015,343 | 9/1935 | Jackson | 222/557 X |
| 2,061,685 | 11/1936 | Wheaton | 141/381 |
| 3,361,307 | 1/1968 | Clare | 222/489 |
| 3,434,637 | 3/1969 | Marcel | 222/570 |
| 3,980,211 | 9/1976 | Owens | 222/478 |
| 4,128,189 | 12/1978 | Baxter | 222/109 |
| 4,664,295 | 5/1987 | Iida | 222/109 |
| 4,696,416 | 9/1987 | Muckenfuhs et al. | 222/109 |
| 4,706,829 | 11/1987 | Li | 222/109 |
| 4,890,770 | 1/1990 | Haga et al. | 222/109 |
| 4,917,269 | 4/1990 | Fuchs et al. | 222/109 |
| 4,981,239 | 1/1991 | Cappel et al. | 222/111 X |

FOREIGN PATENT DOCUMENTS

| | | | |
|---|---|---|---|
| 0109704 | 9/1983 | European Pat. Off. . | |
| 0214675 | 3/1987 | European Pat. Off. | 222/109 |
| 8431343 | 3/1985 | Fed. Rep. of Germany . | |
| 1052876 | 2/1989 | Japan | 222/109 |

*Primary Examiner*—Kevin P. Shaver

*Attorney, Agent, or Firm*—Richard J. Ancel; Robert C. Sullivan

[57] ABSTRACT

A low profile closure which includes a coupling member which is mounted on a container dispensing opening, and an open ended dosing cap including a boundary wall which is dimensioned for removable attachment to an interior surface of the coupling member. The coupling member includes an open ended body portion formed by an upright boundary wall, and a top peripheral edge which defines an outwardly projecting spout. An exterior surface of the dosing cap is arranged in conforming frictional relation to the outwardly projecting spout to provide a low profile closure. Cooperating external and internal threads respectively disposed on the cap boundary wall and coupling body portion are employed to removably fasten the cap in the coupling member.

20 Claims, 6 Drawing Sheets

LOW PROFILE ANTI-DRIP DOSING CAP AND SPOUT FOR LIQUID CONTAINERS

DESCRIPTION

1. Field of Invention

This invention generally relates to a closure which includes an anti-drip cap and spout for use in combination with an open ended upright container. More particularly, the invention concerns a low profile closure which includes an antidrip dosing cap and cooperating spout.

2. Background Art

Molded thermoplastic containers have found wide application in the packaging of liquid detergents, fabric softeners, and other viscous liquid products. Conventional closures employed in such containers include anti-drip pour spouts and cooperating dosing caps. Typically, a pour spout fitment is fastened within a dispensing opening in the container and enclosed with an overlying cap which includes a dosing chamber. Flow restrictor and drainage features are provided in the fitment by provision of inclined base members in the fitment which include openings that communicate with the container interior.

Much attention in the art has been focused on means for reducing the profile of anti-drip closure structures. To accommodate this need, the art has provided fitment structures which include chambers for partial recessed housing of dosing cap structures in a container opening.

This approach is exemplified by U.S. Pat. No. 4,706,829 to Ernest L. Li which is directed to a container dispenser which includes a pour spout, and closure which functions as a measuring cup. The fitment includes an inner portion which defines a pouring lip and outer wall portion which are joined at an annular portion. Wall portion further includes an outwardly extending peripheral flange and integral depending peripheral wall. The flange and depending wall engage an upper surface of the container neck.

The closure includes a top wall, a peripheral wall, an annular wall which extends radially outward from an intermediate location on the peripheral wall, and an annular skirt which depends from annular wall. Peripheral wall is recessed within a cavity formed in the fitment by the spaced arrangement of inner and outer fitment walls, and screw attachment of annular wall to the container neck.

Another approach of the art is disclosed in European Patent Application 0 109 704 (published May 30, 1984) to The Proctor & Gamble Company which shows a combined measuring and closure cap which includes a transition collar and measuring cup. The transition collar, which is attached to a container opening, includes an outer wall, interior pouring spout, and a transverse partition which connects the spout and outer wall. External threads are provided on the cup for its attachment to cooperating internal threads on an interior surface of the outer wall.

German Utility Model GM 84 31 343 (published Mar. 7, 1985) to Colgate-Palmolive Company, the assignee of the present application, shows an insert which coacts with a dosing cap. The insert includes an interior pour spout wall, an outer side wall and connecting annular base wall. Outer side wall includes a terminal outer shoulder which seats the insert in a container neck.

Dosing cap includes a peripheral wall which is recessed in the insert between the interior and outer insert walls. The peripheral wall extends axially within the insert to locations adjacent the lower ends of the insert walls and above the pour spout. A screw attachment of the cap to the container neck is provided by a radial flange and integral threaded skirt which extend outwardly from the peripheral wall. The radial wall flange of the cap overlies the outer insert shoulder to effect sealing engagement of the insert, cap and container neck.

Such conventional closures are characterized by provision of spout structures or fitments which project axially outward from container dispensing openings and are housed within cooperating doser caps. Heretofore, cap designs have necessarily been of high profile in order to accommodate requirements with respect housing fitment structures and providing adequate space for liquid dosages. Further, to impart structural rigidity to the closure and support for the housed fitment, the art has generally employed rigid injection molded cap structures.

The present invention is directed to a low profile anti-drip cap and spout closure which employs a coupling member for removable attachment of a dosing cap to a container opening. Advantage in the invention is obtained through use of an outwardly disposed spout design which overlies exterior surfaces of a cap. It will be appreciated that such an arrangement obviates the need to employ high profile cap structures of the prior art required for housing conventional fitment spouts.

As a further feature of the invention there is provided a cap structure of less complex design than required in the prior art which permits of fabrication by conventional blow molding techniques. Such low profile caps provide cost savings in materials and manufacturing efficiencies over conventional designs.

According, it is the broad object of the present invention to provide an improved low profile anti-drip cap and spout of economical design which is improved over the prior art.

A more specific object of the invention is to provide a coupling member having an integral spout which overlies and houses a cooperating dosing gap.

A still further object of the invention is to provide a container closure which permits of economies in materials and manufacture.

DISCLOSURE OF THE INVENTION

In the present invention, these purposes, as well as others which will be apparent, are achieved generally by providing a low profile closure including a coupling member which is mounted on a container dispensing opening, an open ended dosing cap including a boundary wall which is dimensioned for removable attachment to an interior surface of the coupling member, and means for fastening the coupling member to the container and removable locking of the cap within the coupling member. The coupling member includes an open ended body portion formed by an upright boundary wall, and a top peripheral edge which defines an outwardly projecting spout. An exterior surface of the dosing cap is arranged in conforming frictional relation to the outwardly projecting spout to provide a low profile closure.

In a preferred embodiment of the invention, the spout has a generally arcuate configuration and further comprises means for directing fluid flow in a confined area of the spout, the means including an indented slot in the spout. The directing means effects controlled dispensing of liquid from the container and limits residual coating of liquid on the closure structure, and associated messiness, in dispensing of liquid from the container. To this same end, the preferred embodiment employs cap fastening means which includes cooperating external and internal threads respectively disposed on the cap boundary wall and coupling body portion.

In another preferred embodiment, the spout extends continuously around the entire periphery of the coupling member. Conforming arrangement of this spout in frictional engagement with the exterior surface of the cap boundary wall provides a low profile closure.

Other objects, features and advantages of the present invention will be apparent when the detailed description of the preferred embodiments of the invention are considered in conjunction with the drawings which should be construed in an illustrative and not limiting sense as follows:

BEST MODE OF CARRYING OUT THE INVENTION

Figure 1:
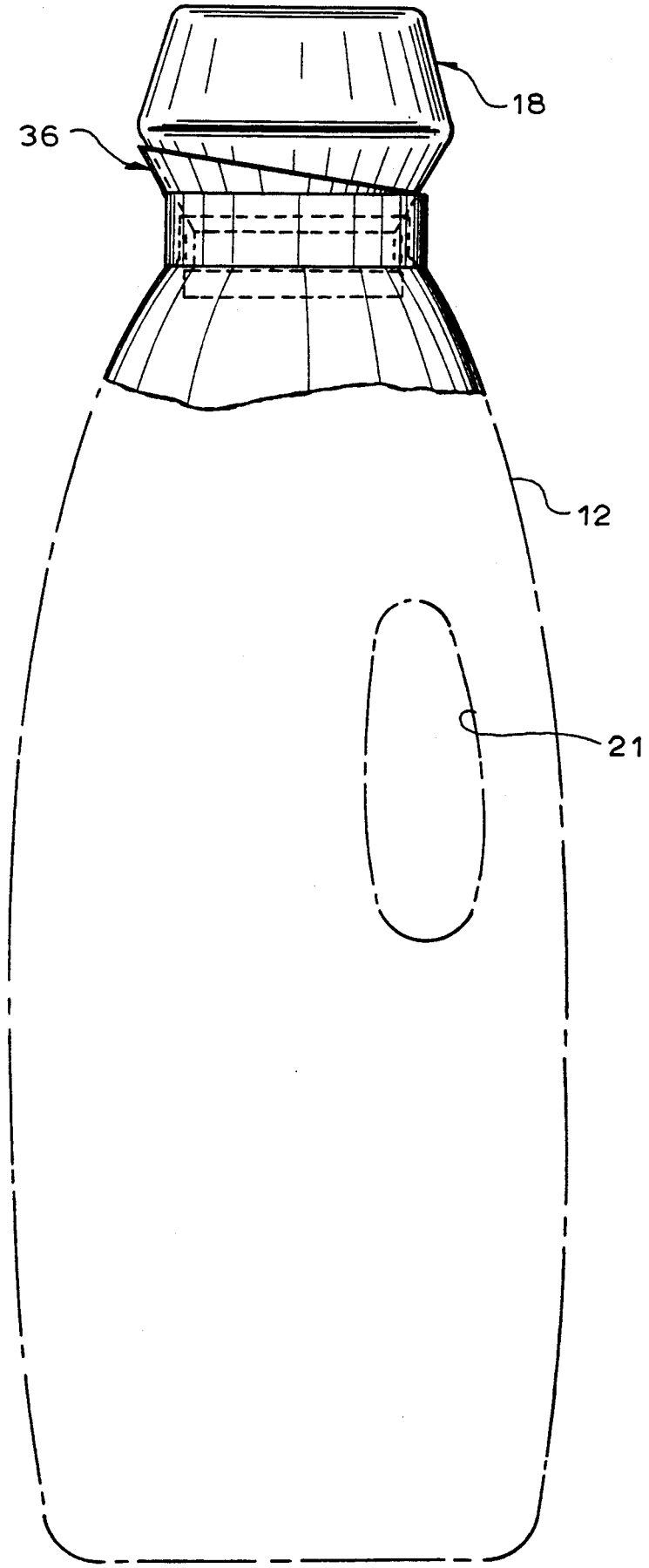
FIG. 1 is a side elevational view of a low profile anti-drip dosing cap and spout closure for liquid containers according to a first preferred embodiment of the invention shown in combination with a container in phantom line.

Referring now to the drawings and, more particularly, to FIGS. 1–7, there is illustrated a low profile closure, generally designated 10, for use in combination with a liquid container 12 having a dispensing opening 14. The closure includes a coupling member 16 which is mounted on the dispensing opening, and a dosing cap 18 which is removably fastened in the coupling member.

The container 12 is preferably fabricated of a moldable polymeric material, such as polyethylene or polypropylene, by conventional blow molding techniques. As will be more fully described hereinafter, the dispensing opening is defined by an upright dispensing wall 20 which includes an outwardly extending flange and arcuate flange segments 22 which define a slot 24. It will be recognized that material specifications for the container are a function of product application, container size and associated stress and crack resistance requirements. The preferred embodiment employs an integral handle member 21 for use in liquid dispensing. Ornamental features and conventional embossed hand grip features may be incorporated in the container.

Figure 2:
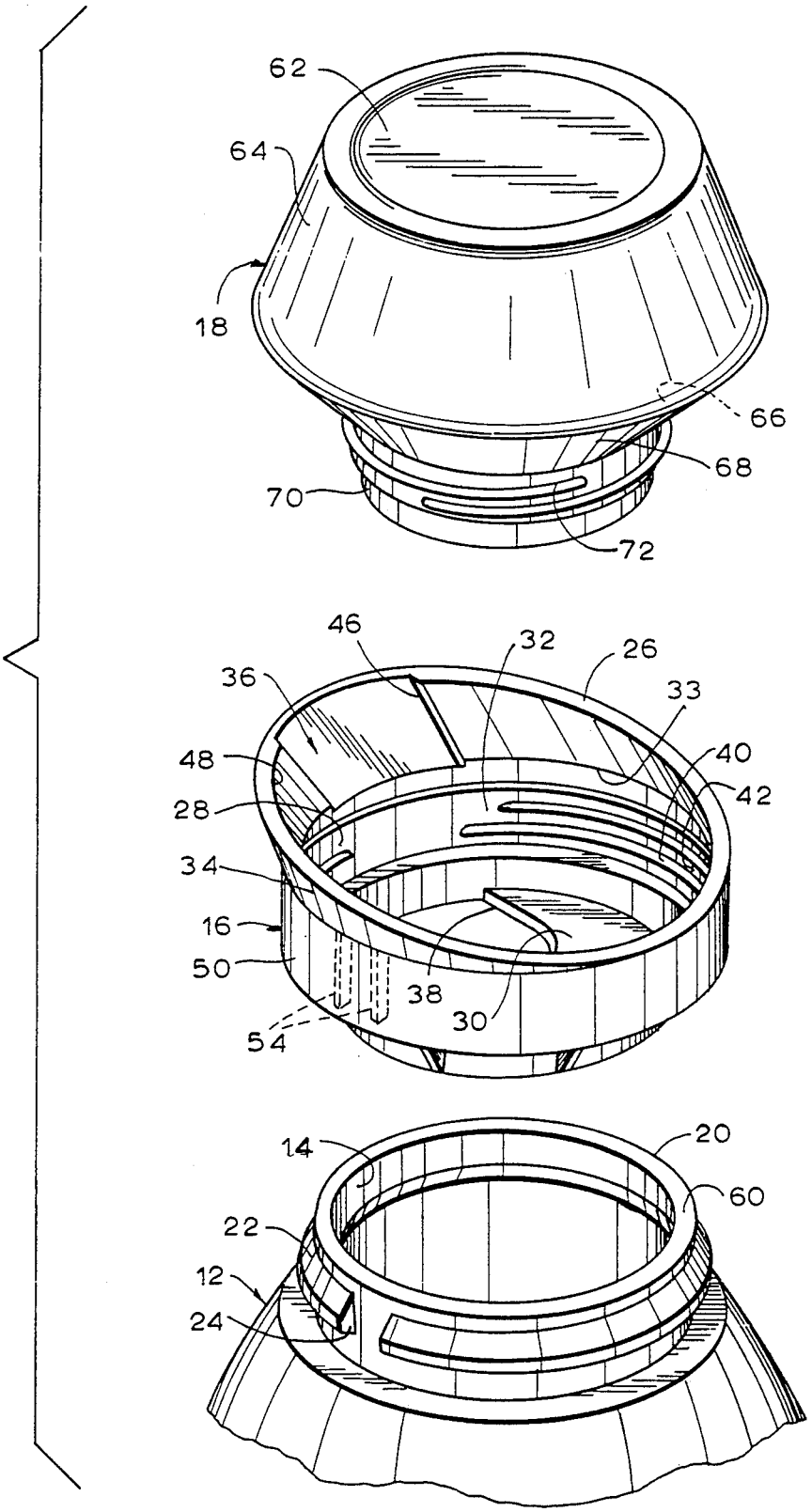
FIG. 2 is an exploded isometric view of the low profile closure and container of FIG. 1.

The coupling member 16, best shown in FIG. 2, is preferably fabricated of a stress resistant polymeric material, for example, a polypropylene, by conventional injection molding techniques. Coupling member 16 includes an open ended body portion, generally designated 26, formed by an upright boundary wall 28, and a base 30. Boundary wall 28 includes a circumferential section 32, having a upper terminal peripheral edge 33, which is received in the dispensing opening, and an integral peripheral edge section 34 which extends outwardly from the dispensing orifice to define a spout 36. A flow restrictor and drainage means in the coupling is provided by base 30 which is disposed on an incline and includes a restrictor opening 38 disposed in general axial alignment with the spout 36. The coupling member also includes internal threads 40 on an interior surface 42 of circumferential section 32. As will be described more fully hereinafter, the internal threads provide a fastening means for removable attachment of the dosing cap to the coupling member. The internal threads 40 include an interrupted segment 44 disposed in alignment with the 36 spout and restrictor opening 38 to facilitate mess-free and unobstructed dispensing of liquid from the spout.

In accordance with a first preferred embodiment of the in the invention, the spout 36 has an arcuate configuration which circumscribes a portion of the peripheral edge 33. Advantage is obtained by the further provision of means for directing liquid in focused flow through the spout. The directing means may include an indented slot or depression 46 in an interior surface 48 of the spout which channels liquids through the spout. The slot 46 is aligned with the interrupted thread segment 44 for cooperation with restrictor opening 38.

Attachment of the coupling member 16 to the dispensing opening 14 is obtained by a circumferential wall 50 which depends from the peripheral edge section 34 and terminates in an inwardly directed flange 52. Circumferential wall 50 is spaced radially outward from boundary wall 28 and overlies an exterior surface of the upright dispensing wall 20 of the container. See FIG. 3. Engagement of circumferential wall flange 52 with corresponding flange 22 in dispensing wall fastens the coupling member and dispensing opening in engagement. Spaced vertical ribs 54, shown in FIGS. 6 and 7, which project inwardly from an interior circumferential wall surface 56, engage slot 24 in the dispensing wall to lock the coupling in a pre-selected orientation with respect to the container opening.

A secondary seal for attachment of the coupling member to the container is provided by a circumferential bead 58 which depends from peripheral edge section 34 from a location intermediate the boundary and circumferential walls 28, 50. Bead 58 sealingly engages a top peripheral edge 60 of the container. Sealing bead 58 which is a relatively rigid injection-blow molded structure is preferably provided with a pointed configuration for engagement with comparatively soft finish of the blow molded container.

Figure 3:
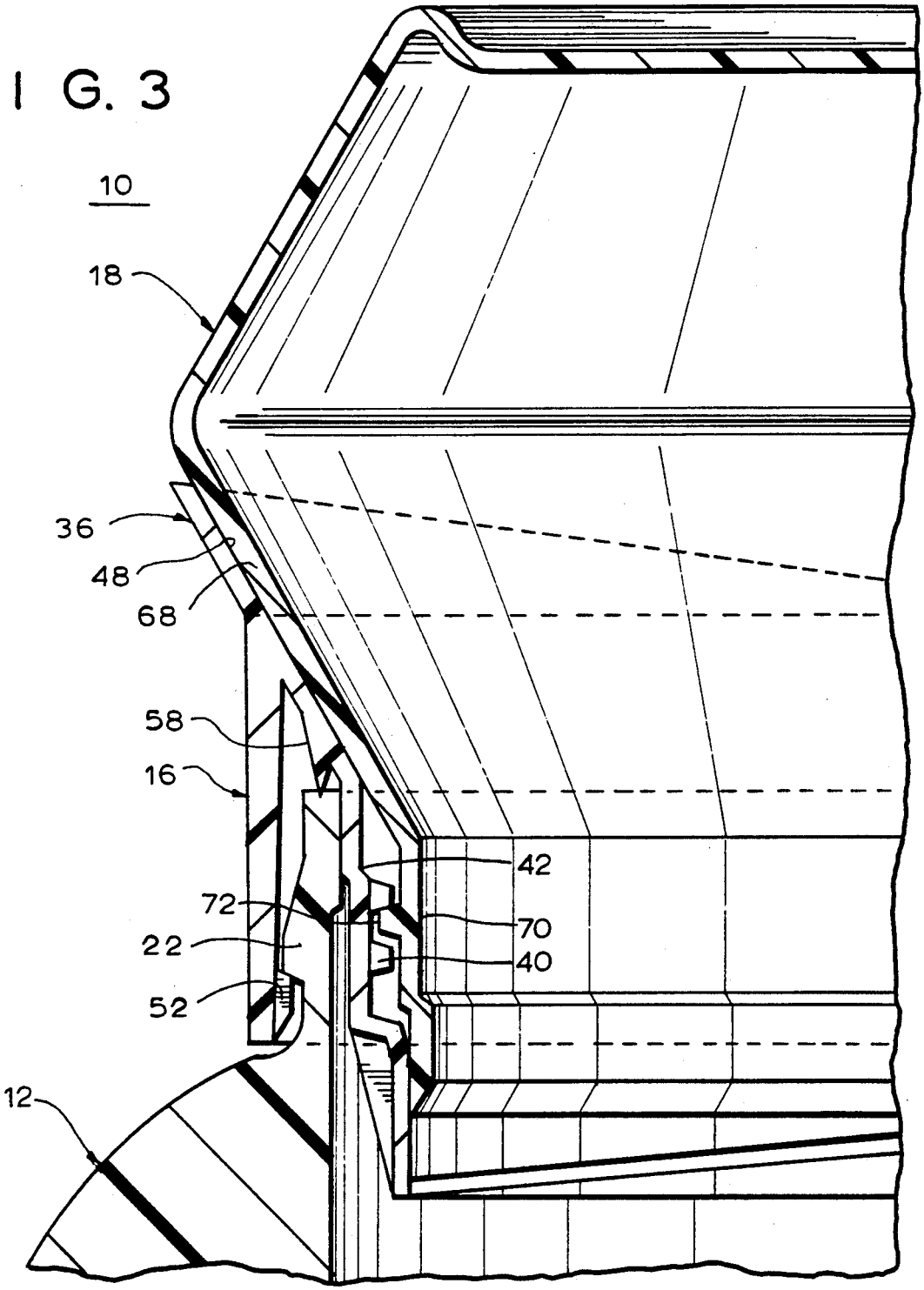
FIG. 3 is a fragmentary sectional view of the low profile cap and container combination of FIG. 1 illustrating fastening means for coupling the closure and container.
Figure 4:
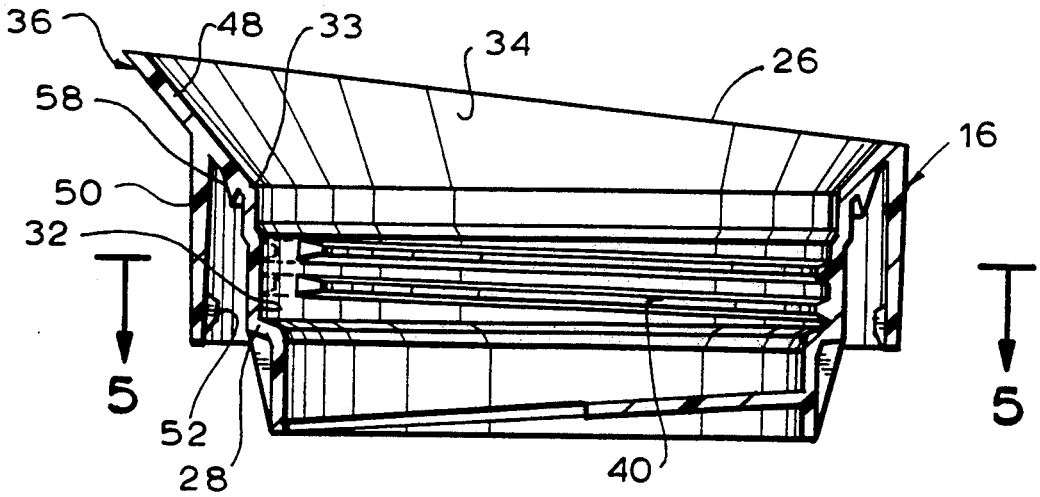
FIG. 4 is a vertical sectional view of the anti-drip spout of FIG. 1.
Figure 5:
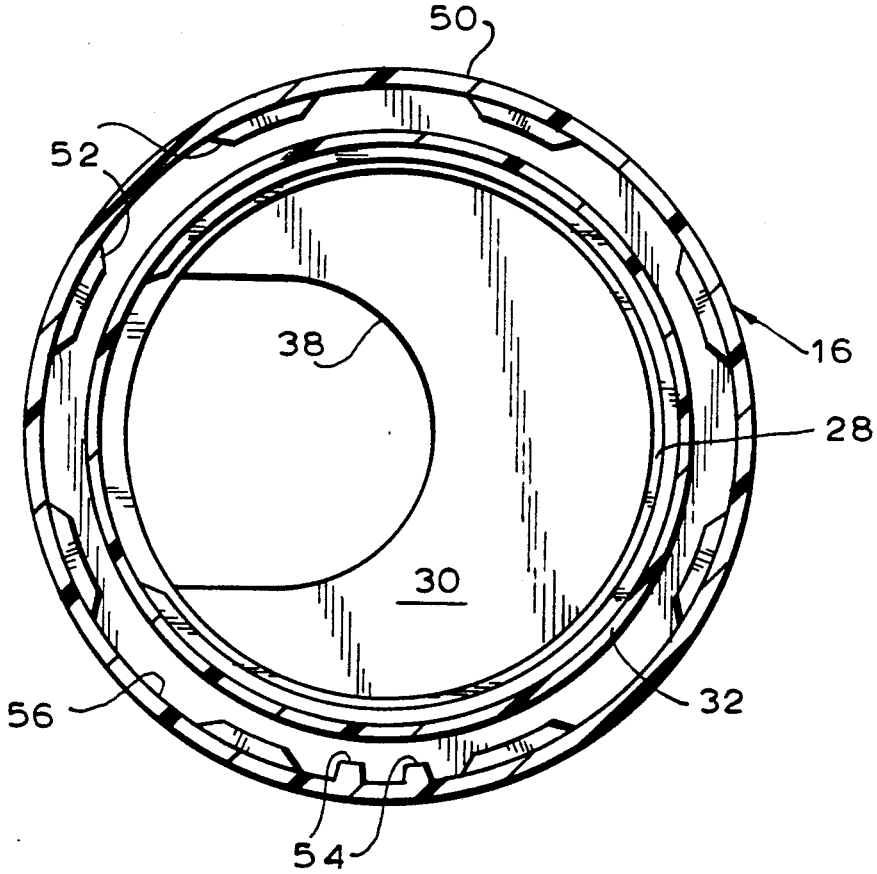
FIG. 5 is a horizontal cross-sectional view of the anti-drip spout taken along the line 5—5 of FIG. 4.
Figure 6:
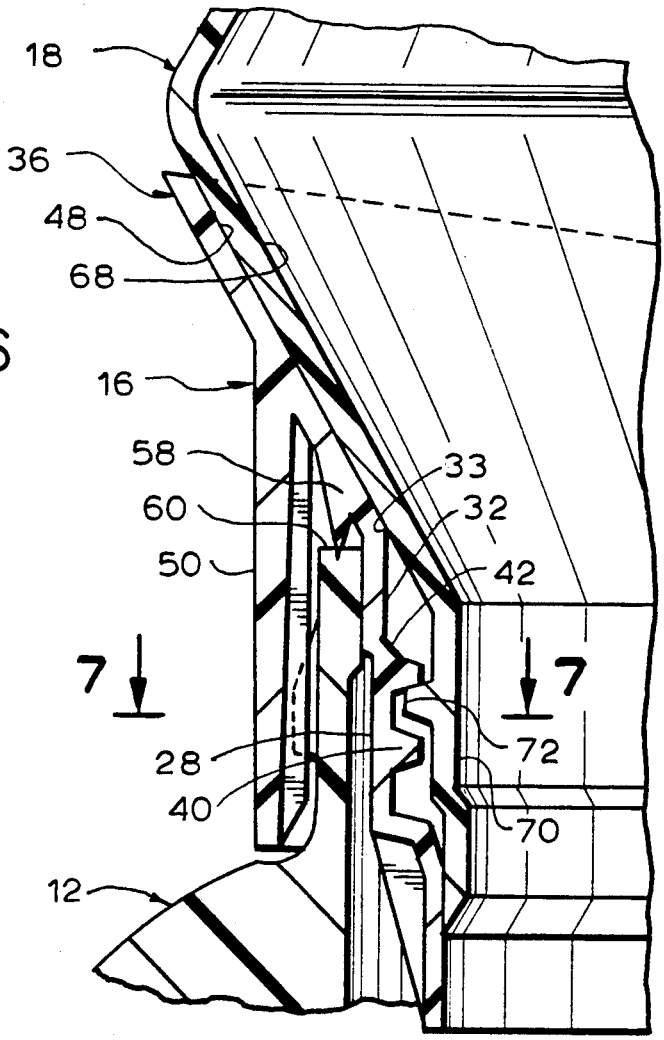
FIG. 6 is a sectional view of the low profile cap of the first preferred embodiment, similar to FIG. 3, illustrating means for locking the closure in a fixed orientation relative to the container.
Figure 7:
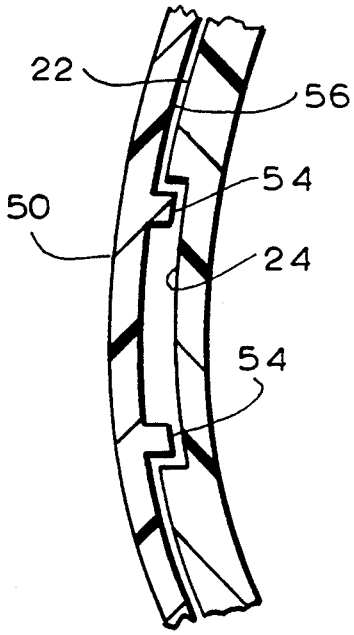
FIG. 7 is a horizontal cross-sectional view taken along the line 7—7 of FIG. 6.

The dosing cap 18, as best shown in FIGS. 2 and 3, is preferably fabricated of a moldable polymeric material, such as polyethylene or polypropylene, by conventional blow molding techniques. Cap 18 includes a top wall 62, and downwardly depending boundary wall 64 which define an interior dosing chamber 66. A low profile interlocking arrangement between the coupling member and cap is provided by configuring the boundary wall 64 to conformingly engage the spout. As shown in FIG. 3, boundary wall 64 includes a lower angular wall section 68 which frictionally engages spout 36. Removable coupling of the cap and coupling member is obtained by engagement of a fastening wall 70, which depends from angular wall section 68, within the coupling member. For this purpose, fastening wall 70 is provided with external threads 72 which cooperate with internal coupling member threads 40.

Figure 8:
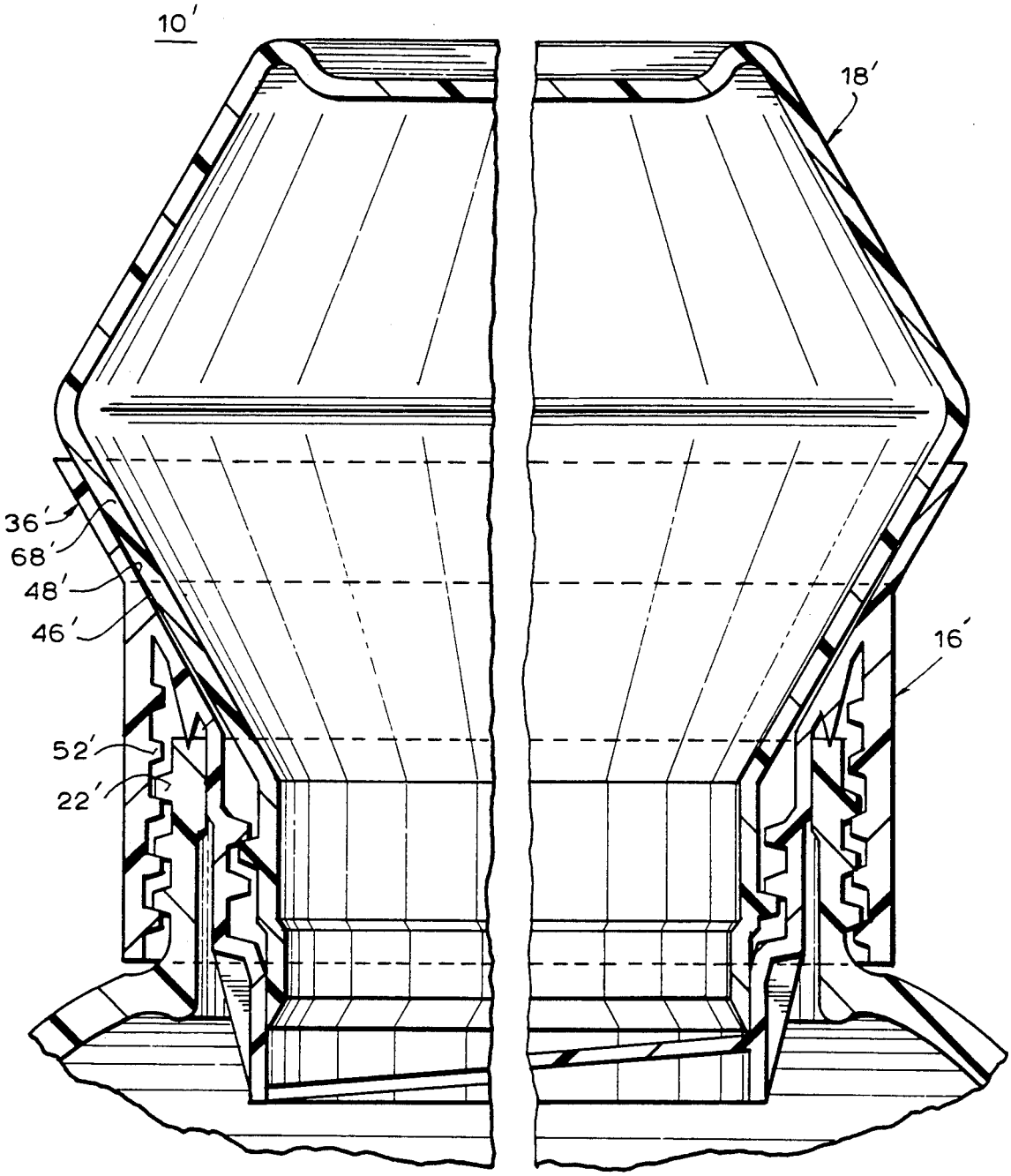
FIG. 8 is a fragmentary sectional view of a low profile cap and container, similar to FIG. 3, according to an alternative preferred embodiment of the invention.

An alternative closure structure, generally designated 10', illustrated in illustrated FIG. 8, comprises a coupling member 16' and dosing cap 18'. This embodiment differs from the first described closure 10 in that the coupling member 16' includes a spout 36' which extends around the entire periphery of the cap. A circumferential gap 46' is provided between angular cap wall 68' and interior surface 48' of the spout. Gap 46' functions in the manner of slot 46 to effect mess-free dispensing of liquid from the container. Further distinction lies in substitution of cooperating threads 52', 22' for locking flanges 52, 22 in the coupling member and container neck.

Advantage is obtained in the invention through provision of a spout 36 which is configured to house a dosing cap and thereby provide a reduced profile closure. It will be recognized that this construction is a departure from prior art designs which employ high profile dosing caps which enclose pour spout structures. See, for example, European Patent Application 0 109 704 (published May 30, 1984) to The Proctor & Gamble Company. Moreover, the outwardly directed spout structure of the invention imparts structural support to the container closure not achieved in prior art designs. This added structural support permits use of blow molded closure caps as distinguished from conventional injection molded cap closures.

It will be recognized by those skilled in the art that use of blow molded dosing caps facilitates use of diverse cap configurations. As contrasted with injection molding techniques, cost efficiencies can be realized in manufacture of diverse cap configurations without requirement of extensive production line retooling.

Numerous modifications are possible in light of the above disclosure. For example, the drawings show a cap having a generally rhomboidal configuration. It will be appreciated that other cap configurations which conformingly seat within a dispensing spout are within the scope of the invention. Similarly, although the preferred coupling member includes a flow restrictor means, it could be dispensed with to facilitate refill of the container. Finally, the preferred cap is fabricated by blow molding techniques, the cap may also be fabricated by injection blow-molding or other conventional process.

Therefore, although the invention has been described with reference to certain preferred embodiments, it will be appreciated that other closure structures may be devised, which are nevertheless within the scope and spirit of the invention as defined in the claims appended hereto.

I claim:

1. A dosing cap and spout for use in combination with a container which houses a liquid, the container having a dispensing opening, the closure comprising:

a coupling member including an open ended body portion formed by an upright boundary wall, and a top end peripheral edge which defines an outwardly projecting spout, said body portion having an interior surface;

means for fastening said coupling member to the dispensing opening;

a dosing cap including a top wall and downwardly depending boundary wall which defines an interior chamber and a dosing opening, said downwardly depending boundary wall having an exterior cap surface, said dosing cap being dimensioned for removable attachment to said coupling member by arrangement of said exterior cap surface in overlying relation with respect to the interior surface of said outwardly projecting spout; and cap fastening means for removably locking said cap in said coupling member.

2. A dosing cap and spout according to claim 1, wherein said outwardly projecting spout is oriented in conforming frictional relation to the exterior cap surface when said dosing cap and coupling member are arranged in locking relation.

3. A dosing cap and spout according to claim 2, wherein said outwardly projecting spout has an arcuate configuration.

4. A dosing cap and spout according to claim 2, wherein said outwardly projecting spout extends around the entire periphery of said open ended body portion.

5. A dosing cap and spout according to claim 1, wherein said coupling member further comprises flow restrictor means for funneling liquid from said closure to the container.

6. A dosing cap and spout according to claim 5, wherein said flow restrictor means includes an angularly disposed base wall and a restrictor opening disposed in a lower end thereof.

7. A dosing cap and spout according to claim 5, wherein said outwardly projecting spout is oriented in conforming frictional relation to the exterior cap surface when said dosing cap and coupling member are arranged in locking relation.

8. A dosing cap and spout according to claim 7, wherein said spout further comprises means for directing liquid flow in a confined area of said spout, said directing means including an indented slot in an interior surface of said spout.

9. A dosing cap and spout according to claim 2, wherein said cap fastening means includes cooperating external and internal screw threads respectively disposed on said boundary wall and body portion.

10. A dosing cap and spout according to claim 9, wherein said spout further comprises means for directing liquid flow in a confined area of said spout, said directing means including an indented slot in an interior surface of said spout, and said internal threads include an interrupted section disposed in axial aligned relation to said indented slot.

11. A dosing cap and spout according to claim 10, wherein said peripheral edge defines a spout which has an arcuate configuration.

12. A dosing cap and spout according to claim 11, wherein said cap and coupling member are respectively fabricated of blow molded and injection molded thermoplastic materials.

13. A dosing cap and spout according to claim 12, wherein the coupling member is fabricated of a harder thermoplastic material than the container.

14. A dosing cap and spout for use in combination with a container which houses a liquid, the container having a dispensing opening, the closure comprising:

a coupling member including an open ended body portion formed by an upright boundary wall having an interior surface, and a top end peripheral edge which defines an outwardly projecting spout;

coupling means for fastening said coupling member to the dispensing opening;

a blow molded dosing cap including a top wall and downwardly depending boundary wall which encloses a dosing chamber, said depending boundary wall including a terminal end which defines a dosing opening and an angular wall section which extends outwardly from said terminal end, said downwardly depending boundary wall also including an exterior cap surface, said dosing cap being dimensioned for removable attachment to said coupling member by arrangement of said exterior cap surface in engagement with the interior surface of said body portion; and cap fastening means for removably locking said cap in said coupling member;

said outwardly projecting spout being oriented in conforming frictional relation to an exterior surface of said angular wall when said dosing cap and coupling member are arranged in locking relation.

15. A dosing cap and spout according to claim 14, wherein said outwardly projecting spout has an arcuate configuration.

16. A dosing cap and spout according to claim 14, wherein said outwardly projecting spout extends around the entire periphery of said open ended body portion.

17. A dosing cap and spout according to claim 14, wherein said coupling member further comprises flow restrictor means for funneling liquid from said closure to the container, said flow restrictor means including an angularly disposed base wall and a restrictor opening disposed in a lower end thereof.

18. A dosing cap and spout according to claim 17, wherein said cap fastening means includes cooperating external and internal screw threads respectively disposed on the boundary wall of said cap and said coupling member.

19. A dosing cap and spout according to claim 18, wherein said spout further comprises means for directing liquid flow in a confined area of said spout, said directing means including an indented slot in an interior surface of said spout, and said internal threads include an interrupted section disposed in axial aligned relation to said indented slot.

20. A dosing cap and spout according to claim 19, wherein said coupling means comprises cooperating snap engaging projections in the coupling member and the container.

* * * * *